US007076184B2

(12) United States Patent
Zwiefelhofer

(10) Patent No.: US 7,076,184 B2
(45) Date of Patent: Jul. 11, 2006

(54) EXPENSE RECOVERY SYSTEM FOR COPIER

(76) Inventor: Ray Zwiefelhofer, 4022 E. Broadway Rd., Suite 122, Phoenix, AZ (US) 85040

( * ) Notice: Subject to any disclaimer, the term of this patent is extended or adjusted under 35 U.S.C. 154(b) by 200 days.

(21) Appl. No.: 10/841,065

(22) Filed: May 7, 2004

(65) Prior Publication Data

US 2004/0223778 A1 Nov. 11, 2004

Related U.S. Application Data

(60) Provisional application No. 60/469,183, filed on May 8, 2003.

(51) Int. Cl.
*G03G 21/02* (2006.01)

(52) U.S. Cl. ..... 399/79; 399/8; 705/34

(58) Field of Classification Search ..... 399/79, 399/80, 8, 9, 10, 11; 705/34
See application file for complete search history.

(56) References Cited

U.S. PATENT DOCUMENTS

| | | | | |
|---|---|---|---|---|
| 6,026,380 | A | 2/2000 | Weiler | |
| 6,216,113 | B1 * | 4/2001 | Aikens et al. | 705/34 |
| 2001/0053295 | A1 * | 12/2001 | Kujirai et al. | 399/79 |
| 2005/0129423 | A1 * | 6/2005 | Lester et al. | 399/79 |

* cited by examiner

*Primary Examiner*—Sophia S. Chen
(74) *Attorney, Agent, or Firm*—Etherton Law Group, LLC; Sandra L. Etherton

(57) ABSTRACT

An expense recovery system for a digital copier in the form of a modification to the application program interface of the copier to allow input of identifiers for the user, the client and the job and to transmit this information and other transaction data to an expense recovery server for billing purposes.

23 Claims, 5 Drawing Sheets

EXPENSE RECOVERY SYSTEM FOR COPIER

CROSS-REFERENCE TO RELATED APPLICATIONS

This application claims the benefit of co-pending U.S. Provisional Application 60/469,183 filed May 8, 2003.

FIELD OF INVENTION

This invention relates generally to managing digital copy output systems, referred to herein as copiers or photocopiers. This invention relates particularly to a method and apparatus for improving copy accountability utilizing a server networked to one or more copiers.

BACKGROUND

Photocopiers are well known in the art. When the copier illuminates a sheet of paper on the glass surface of a copier, a pattern of the image is projected onto the positively charged photoreceptive drum below. Light reflected from blank areas on the page hits the drum and causes the charged particles coating the drum's surface to be neutralized. This leaves positive charges only where there are dark areas on the paper that did not reflect light. These positive charges attract negatively charged toner. The toner is then transferred and fused to a positively charged sheet of paper, creating an image that matches the original.

In the process of performing services for clients, many businesses make copies of documents on copiers. The expense of copying is significant. In an attempt to recoup the copy expenses, many businesses, especially firms that bill by the hour for their services such as law, accounting, and consulting firms, charge the clients for each copy made. Efficient management of copies can actually turn the copy center into a profit center for the business, which provides incentive for providing copy accountability with a number of methods.

For example, it is known in the prior art to install a copy control module onto a copier. The copy control module asks the user to enter in a user identifier (ID) and a client identifier. Upon receipt of valid user identifier and client identifier, the control module enables a switch that allows the copier to make copies. The copy control module is not able to receive data from the copier, so the copy control module determines the number of copies made by counting electrical spikes which occur each time a copy is made (referred to in the industry as counting flashes), and associates the number with the client identifier. Counting flashes is inherently inaccurate because of difficulties differentiating data spikes from noise, as well as the fact that spikes are often created with no resultant copy, for example as paper gets stuck or toner runs out, etc.

Data is either manually collected at the copier with a portable computer or transmitted through copy control module network lines to the business's time and billing (or accounting) system, which adds the cost of the copies made to the client's bill. The disadvantages of this system include that each copier requires its own copy control module, and the modules are typically supplied by a different vendor than the copier. It is desirable to have a more accurate means of tracking copy counts. It is also desirable to eliminate the copy control module and yet be able to track associated copies made to client accounts.

A typical example of a prior art copy control module system is described in U.S. Pat. No. 6,026,380, assigned to On-Site Sourcing, Inc. This patent describes a photocopy count system that requires one remote mini-terminal to be associated with each photocopier. The mini-terminals communicate with a central control computer via a multiport serial board. The patent describes two different mini-terminal versions to suit photocopiers from Xerox Corporation and photocopiers from Canon, Inc. This highlights the problems identified above of a separate copy control module being required for each photocopier and different versions of the hardware being required for each brand of copier.

Copier companies typically charge the businesses a fee for each copy made, as well as a monthly fee for servicing each copier. Periodically a service technician visits each copier to monitor and record the number of copies the copy control module has counted. For large law firms, servicing each copier could mean visiting several copiers on each of multiple floors—a time-consuming process. Furthermore, at a specific copy count, the technician conducts preventive maintenance on the copier. It is desirable to service the machine near a desired number of copies to keep the machine in good working order. However, due to the labor-intensive nature of having to visit each copier to determine the number of copies made, sometimes the number of copies greatly exceeds the suggested volume before preventive maintenance is performed, thereby risking potential damage to the equipment or permitting it to print lower quality copies. For lower volume copiers, the visits to each copier are largely a waste of time.

From the business's internal perspective, it is desirable to know who is making copies, how long it takes (turnaround time), what the job is for, etc. It is desirable to be able to track copy jobs at a job-level for internal expense tracking, as well as from a client perspective for external expense tracking.

Advances in digital technology and web-based computing have improved copier performance. In contrast to analog copiers that use the physical translation of an image on one piece of paper to another, digital copiers create and receive data in digital format and create the image from the data directly on the drum. Due to the ability of digital data to be quantified, for example in single page quantities, the number of copies made can be determined accurately. It is desirable to access the accurate counts of copies directly.

Due to the benefits of digital technology, digital copiers can do much more than simply make copies of a paper document. For example, many digital copiers can make a photocopy of a paper document, print a paper document from an electronic file, scan a paper document and create an electronic file that can be stored or transmitted digitally, or fax a digital file from either a scan of a paper document or from an electronic file.

The data stream for digital copies can come from multiple sources, such as a print request from a print file, a fax, or a scan of a paper image. Because these copiers are so versatile, they are often electrically connected (networked) to transmit data, by hardwire or wirelessly, to remote personal computers (PC). Because digital copiers can now be configured as stations on a network, a user of a personal computer on the network can send a print request to a copier instead of a printer in order to obtain a paper copy of the document. The user can also scan, fax and email from the copier. Further, the same network connection that lets a user transmit a print job to the copier can also be used to transmit information from the copier. It is desirable to transmit such information to a central server that can compile data from multiple copiers. It is also desirable to communicate that information to a business's accounting or time and billing system, so that clients can be charged for the number of copies (documents) made.

Therefore, it is an object of this invention to provide a system of copy accountability that can be managed from a central location or server. It is another object to utilize the built-in network connection of a copier to transmit to and receive data from this central server. It is another object of this invention to eliminate the need for a separate copy control module at each copier. It is a further object to utilize a copier's built-in hardware and software for data entry, data validation, and job tracking. It is another object to count and track copies accurately by obtaining copy counts from the copier in digital format, as opposed to measuring a count independently of the copier. It is another object to count and track copy jobs accurately. It is a further object of this invention to provide a system that enables the compilation of data from multiple copiers and provide necessary conversion and importation into the business billing system.

SUMMARY OF THE INVENTION

The present invention is a computer-based method and apparatus for document accounting, expense recovery and management. The system utilizes an expense recovery server that is networked with one or more digital copiers and a time and billing system. The system utilizes the copiers' built-in network connections to transmit to and receive data from this expense recovery server and to the time and billing system. The application program interface in the copier is modified to include an expense recovery module that facilitates input of data and communication with the expense recovery system and the time and billing system.

To make copies for a client, the expense of which is to be later recouped from the client, a user enters a user identifier and a client identifier into the copier's touch screen or keypad that has an interface that captures information from the user and transmits it to the expense recovery server before copying starts. No external copy control terminal is used. In one form the user identifier and a client identifier are validated by the expense recovery server against a current user and client list, which is available from the existing billing system. In another form these functions are performed locally at the copier.

Upon entry of valid identifiers, the copier is enabled to make copies. If no valid client identifier is entered, the system can be set to default to a default identifier and the copier is enabled, or set to deny access until a valid identifier is entered. Upon completion of the copy job information is transmitted to the expense recovery server to associate the number of copies with the appropriate client (or default) identifier, and transmits the information to the time and billing system for future billing to the client and cost recovery. The user may periodically receive an accounting of copies that were made to the default identifier for further review, commonly known as exception editing. The expense recovery server also tracks job data and prints reports or transmits the information to another of the business's computers for association with other data. The expense recovery server will also track scans, faxes and prints through the copier, as well as track phone call information.

DETAILED DESCRIPTION OF THE INVENTION

Hardware Configuration of Improved Document Accounting Apparatus

Figure 1:
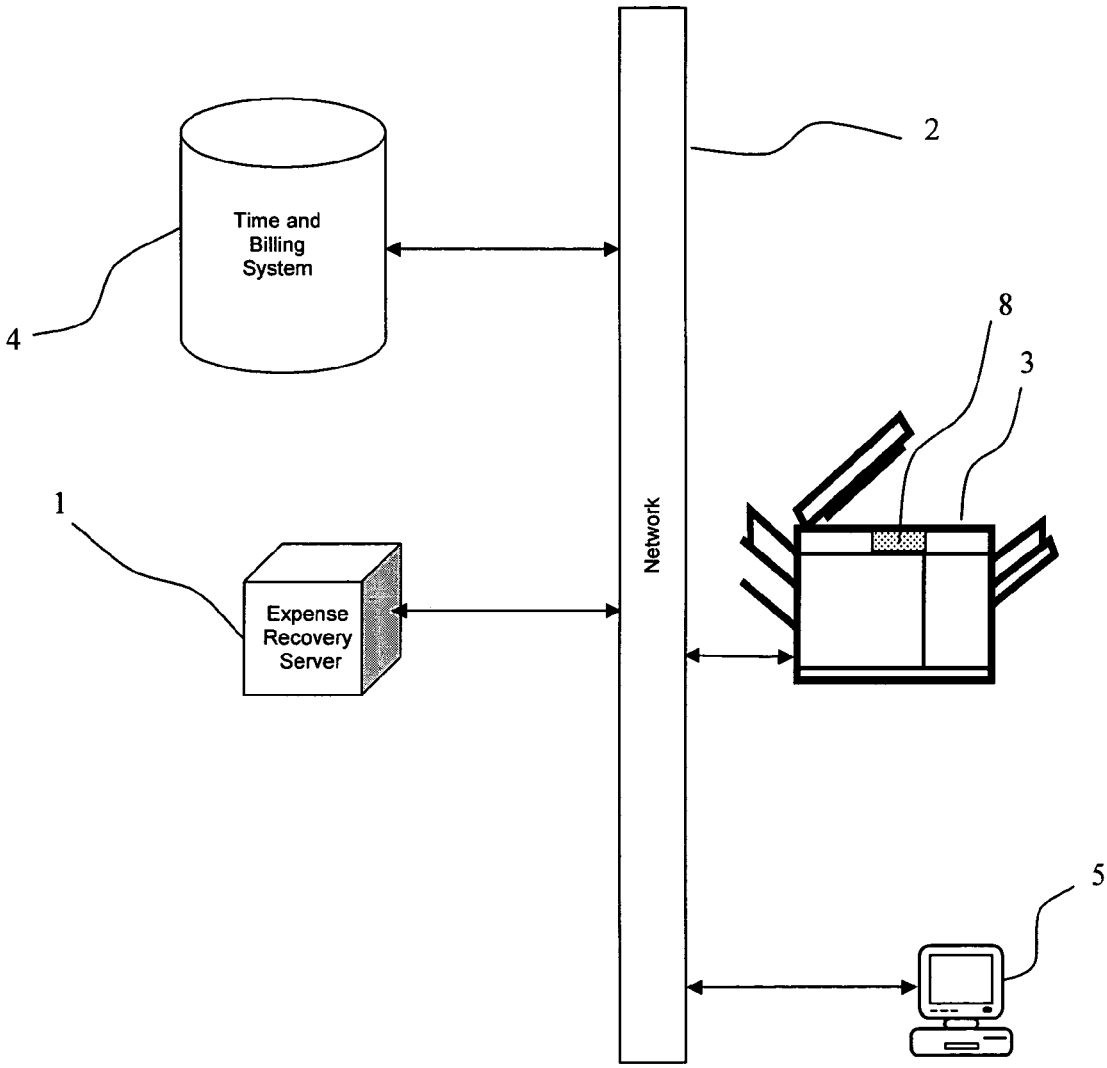
FIG. 1 a schematic view of the present system.

FIG. 1 shows the present invention, which utilizes an expense recovery server 1 that is networked 2, by hardwire or wirelessly, with a digital copier 3 and a time and billing system 4. The expense recovery server 1 is programmed to interface with numerous different brands of time and billing and accounting systems, such as DHDial & Company, ELITE, ESI-Law, FOROB, Juris, L.A.W.S., Legal Master, Omega, PCLaw, Perfect Practice, Prolaw, TABS3, Timeslips, and Visual Practice Management. Data is transmitted to and from the expense recovery server 1 and the time and billing system 4 via the network 2. The expense recovery server 1 is also programmed to interface with numerous different brands of copiers, such as Canon, HP, Kodak, Konica, Lanier, Minolta, Ricoh, Savin, Toshiba, Xerox. Data is transmitted to and from the expense recovery server 1 and the copier 3 via the network 2. A number of PC's 5 may also be connected to the network 2 to access the expense recovery system 1 and copier 3.

The copier 3 is programmed to cooperate directly with the expense recovery server 1. A digital copier has a touch screen 8 (or keypad with LCD screen) that the user manipulates to enter data and otherwise indicate to the copier what task is to be done. This touch screen has a graphical user interface (GUI) and application program interface (API) which is modified to accept data from the user that is then conveyed to the expense recovery server 1 by the copier 3. The API is modified to include software for an expense recovery module that utilizes the GUI to display fields to accept additional user input. In the preferred embodiment, this modified interface accepts user identifiers and client identifiers and transmits them to the expense recovery server 1. The API may be further modified to accept additional parameters such as job number, price per copy, or others. Because the expense recovery server 1 is connected to the copier 3, a separate copy control module is not needed at each copier.

It is most convenient for the expense recovery server to run as a web server. While the application program interface can be programmed in any number of ways in any programming language, in the preferred embodiment the application program interface will be web-enabled, using http and TCP/IP protocols and XML programming languages, as is known in the art. The preferred embodiment will perform the following functions:

Initiate communication between the copier and an expense recovery module;

Provide a setup field to identify the expense recovery server TCP/IP address;

Prompt for billing fields when the copier button is activated. If a network connection time-out occurs, the billing numbers entered may be validated against a locally stored table on the copier.

Provide XML defined screens that contain from 1 to 4 input fields and one or two action buttons. Each input field may receive up to 20 alphanumeric characters. The input fields may be text entry or dropdown box;

Receive text entry via an input means on the copier, such as the keypad or touch screen;

Pass screen content to the expense recovery server when an action button is activated; or upon network outage transactions may be stored locally until such time that network connectivity is restored.

Accept a 'success flag' from the expense recovery server and display the standard copy screen;

After a copy transaction, submit a transaction record to the expense recovery server. The transaction record includes: copier identifier, date/time stamp, copy count (or initial meter count and final meter count), transaction termination status.

Of course, additional functions may be added, such as recording the copier operator's identifier.

Figure 2:
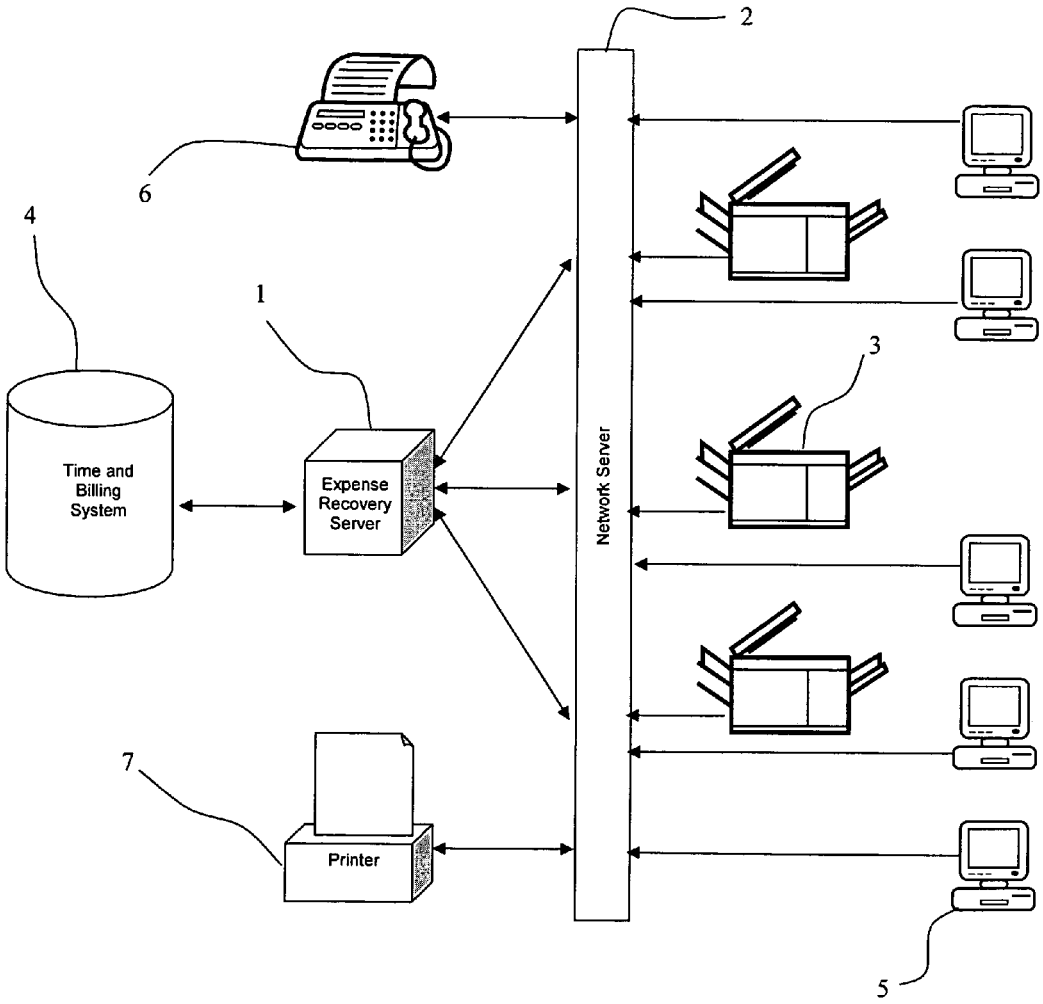
FIG. 2 illustrates the present system with multiple networked copiers, multiple PC's and other devices.

The expense recovery server is a specialized networked computer that has been built to do a particular job or jobs very well, FIG. 2 illustrates an expense recovery server networked to multiple copiers 3 and multiple PC's 5. The effect is that for a medium size law firm having 100 copiers, only one expense recovery server 1 is necessary for copy control management of the entire firm, greatly reducing the cost compared to over 100 copy control modules in addition to a cost recovery server, and intensive service technician time. The network connections are typically 100 base T cable, or the equivalent.

Improved Document Accounting Method

In addition to the apparatus described above, the present invention also comprises a process for improved copy management and accountability. FIG. 2 illustrates a process flow of the present invention. To make copies for a client, the expense of which is to be later recouped from the client, a user enters a user identifier and a client identifier into the copier's touch screen or keypad that has an interface that captures information from the user and transmits it to the expense recovery server before copying starts. The user identifier and a client identifier are validated by the expense recovery server against a current user and client list, which is available from the existing billing system.

Figure 3:
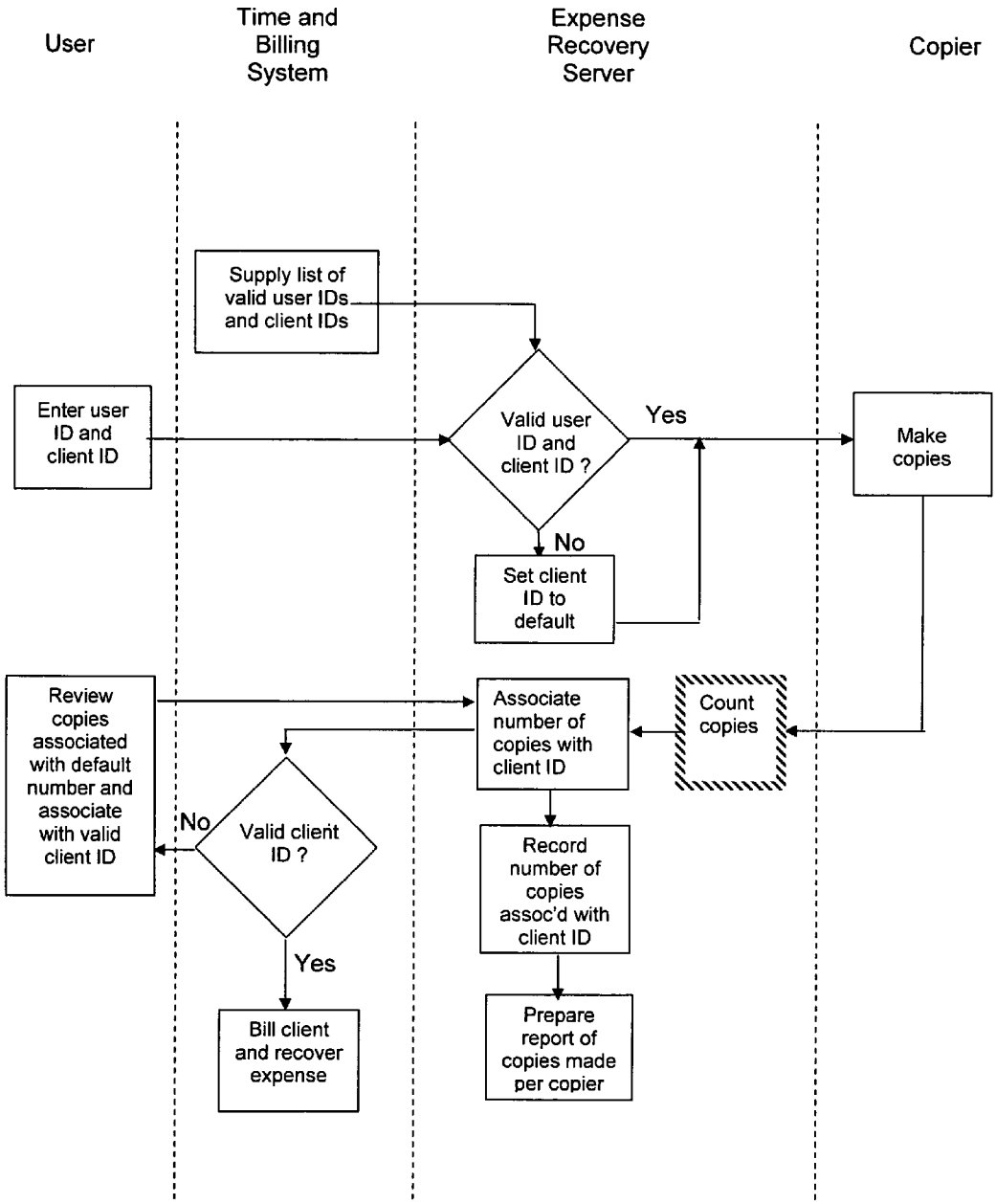
FIG. 3 is a flow chart representing the operation of the present system.
Figure 4:
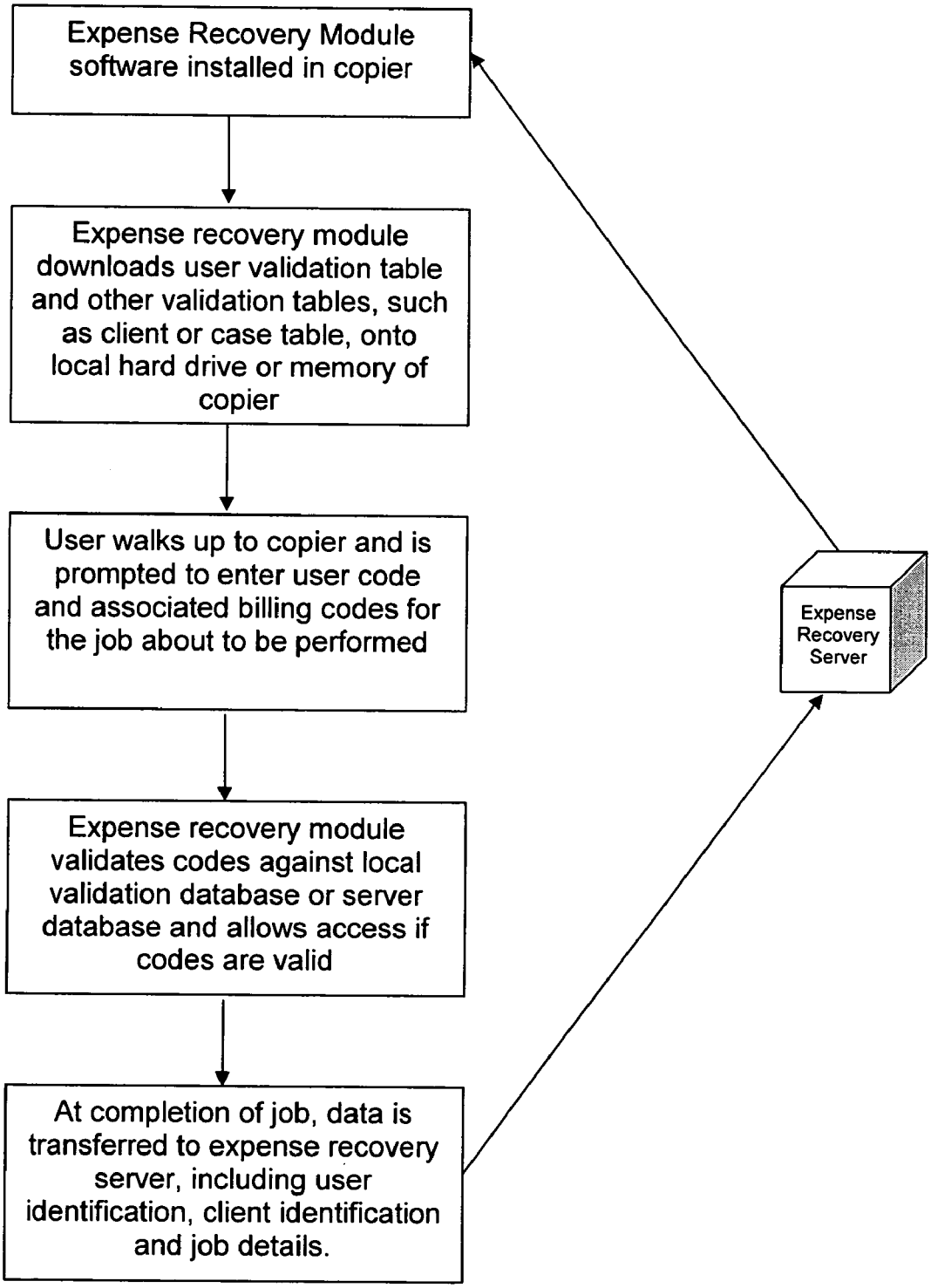
FIG. 4 depicts operational flow from a user perspective.

As depicted in FIG. 3, the current list of valid user identifications and client identifications are retrieved from an identification store in the time and billing system for use by the expense recovery server. It will be appreciated that in a network environment the physical location of the identification store can be in any of several locations, as the identification store can be accessed from anywhere on the network. In some instances it may be beneficial to periodically copy the identification store from the time and billing system to storage in the digital copier to reduce network traffic and avoid the impact of network outage. An operational flow diagram for this embodiment is shown in FIG. 4.

Upon entry of valid identifiers, the copier is enabled to make copies. If no valid client identifier is entered, the system can be set to default to a default identifier and the copier is enabled; or deny access to copier until a valid identifier is entered. Copies are made and the expense recovery server obtains the accurate copy count directly from the copier—no independent measurement needs to be made. When the copy job is complete, a transaction record includes a set of data including copier serial number, date, time, copy count (or meter start, meter end), and status. The expense recovery server associates this information with the appropriate client (or default) identifier, and transmits the information to the time and billing system for future billing to the client and cost recovery. The user may periodically receive an accounting of copies that were made to the default identifier for further review.

The expense recovery server may be electrically connected to other computers or peripheral devices which may be monitored for copy count, including a fax machine 6 or a printer 7. FIG. 2 illustrates the present system connected to a fax, a printer, and a digital copier. Further, the expense recovery server may be connected to the Internet and employ a web browser so that it can be monitored at the server, within the firm, or remotely through the Internet or virtual private networks (VPN) using a PC. Reports and data can be exported in numerous formats. Access to the expense recovery server is password protected, and may have several other levels of security for different users.

Improved Workflow System

Figure 5:
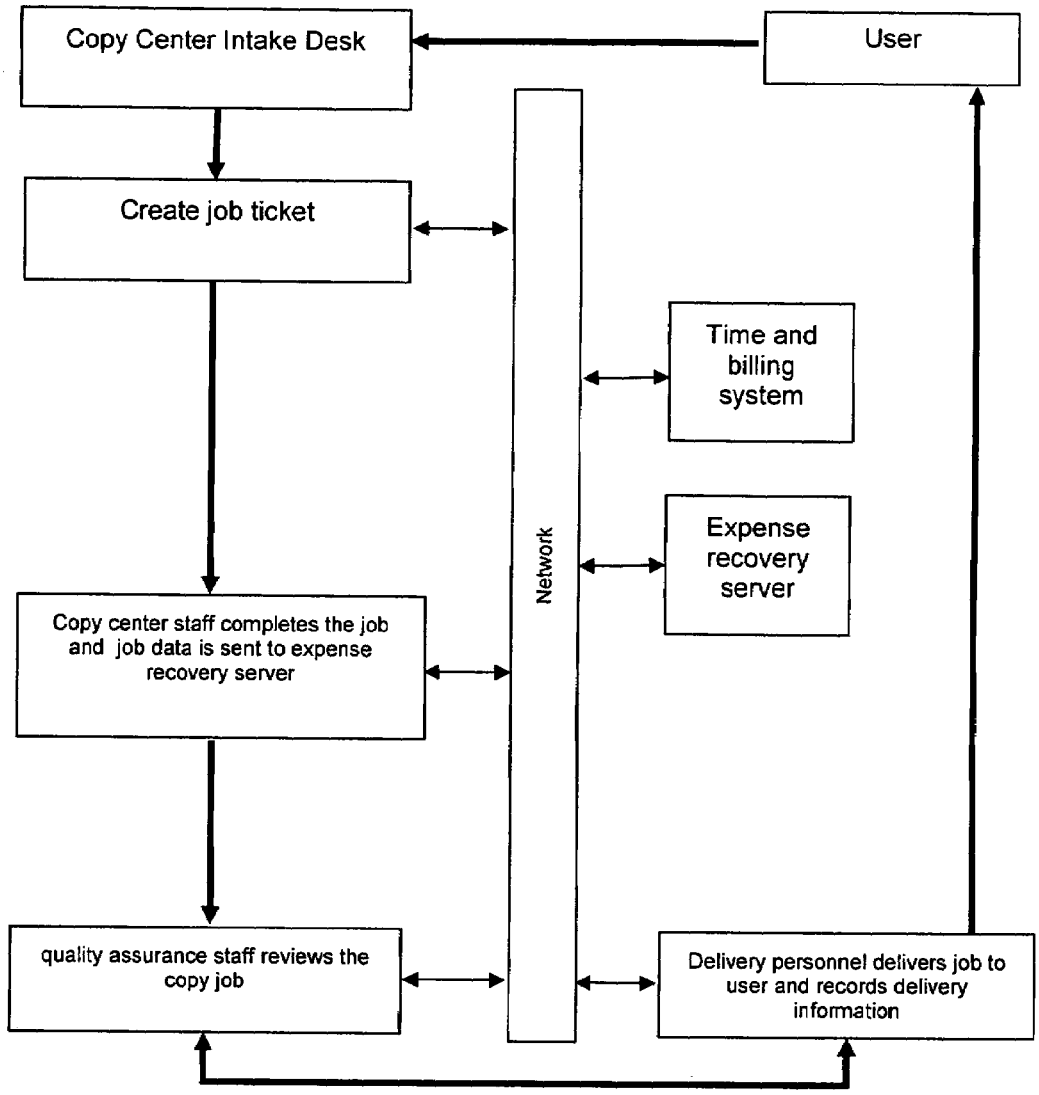
FIG. 5 is an overview of workflow through a copy center with the present system.

The present invention also comprises a process for improved production workflow tracking, or job tracking. FIG. 5 shows an overview of the workflow using the present system. The job request arrives in copy center from a user, either electronically, by hand-delivery, messenger or telephone. The copy center intake desk enters the job into the electronic queue, which is communication with the expense recovery server. The job is assigned a job number, either manually or automatically by the system, and an electronic job ticket is filled out. Data on the job ticket may include requestor, client matter, date and time in, date and time due, and a description of job details. The user identifier and a client identifier are validated by the expense recovery server against a current user and client list, which is available from the existing billing system. The job is completed by the copy center staff, including copying, quality assurance, and delivery. Quality assurance staff may enter job data, as well. For example, if a job has to be redone, the renegotiated due date and time can be entered. Or, the replacement copies can be subtracted from the total job count; with proper tracking, the client will not be charged for poor quality copies. The delivery staff can also enter data into the expense recovery server, such as the time delivered. When the copy job is complete, transaction record information can be used to identify each copy, print, scan or fax job, as well as the turnaround time for each job, and the person handling the job. The expense recovery server can produce reports using this data, or transmit the data to a business's central computer using existing network connections for associating the job data with internal company data. The combination of client-level cost recovery with job-level production tracking improves internal production workflow, thereby reducing time and cost.

Pricing of System

Conventionally, a firm will pay a fee to purchase or lease each copy control module, plus a monthly fee to have the service technician visit each copier, as well as a fee for the number of copies made. The present system has the advantage of being able to remotely determine the number of copies made and which copiers are in need of preventive maintenance. Further, the cost of the expense recovery server and installation is much lower than the cost of numerous copy control modules.

Reports

The reports to the user can be printed, faxed, or emailed using the expense recovery server's web access. The resulting bill sent to the client can be formatted in any number of ways, including sorting and filtering by client number, matter number, responsible attorney, date, cost, description code, user identifier, location, city, state, copier type, copier trend usage, volume statistics, copier uptime, copier preventative maintenance history, employee time spend on the job, etc. Finally, because the system interfaces with the time and billing system, each client can easily be charged a different cost for its copies.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

I claim:

1. A method of accounting for a job at a copier including the steps of:

receiving identifiers in the copier via an input means of the copier;

comparing the identifiers to a store of the identifiers;

enabling the copier with a copy enable signal; and after completion of the job, transmitting transaction data relating to the job to an expense recovery server via a communications network.

2. The method of claim 1 wherein the store of identifiers resides in the copier.

3. The method of claim 1 wherein the store of identifiers resides in a time and billing server in signal communication with the copier via the network.

4. The method of claim 1 wherein the store of identifiers resides in the expense recovery server.

5. The method of claim 4 further including the step of the copier transmitting the identifiers to the expense recovery server to effect the comparing step.

6. The method of claim 4 wherein the copy enable signal is transmitted to the copier from the expense recovery server via the network.

7. The method of claim 1 wherein the transaction data includes: a user identification, a client identification, a transaction count, and a transaction termination status.

8. The method of claim 1 further including a step of recording transaction data against a default identifier if the step of comparing does not find the identifiers in the store of identifiers.

9. The method of claim 1 further including a step of remotely monitoring the transaction data for compiling reports.

10. A computer readable medium within a copier having instructions which, when executed by the copier, perform steps including:

requesting identifiers before enabling copying;

receiving the identifiers via an input means of the copier;

recognizing an enabling signal to enable operation of the copier; and at the completion of copying, transmitting transaction data to an expense recovery server.

11. The computer readable medium of claim 10 further including instructions to transmit the identifiers to the expense recovery server and wherein the enabling signal is received from the expense recovery server.

12. An application program interface for a copier comprising:

a call to an expense recovery server when a copy button on the copier is activated;

one or more screens generated and displayed on a screen of the copier;

one or more fields on each the screen for input of data;

one or more action buttons for activating transmission of the data to the expense recovery server;

means responsive to a copy enable signal from the expense recovery server to enable operation of the copier for a job task; and transmission of transaction data to the expense recovery server upon completion of the job task.

13. The application program interface of claim 12 wherein the one or more fields are text fields and the data is text data.

14. A method of accounting for a job performed by a copier including the steps of:

receiving in an expense recovery server identifiers input via input means of the copier;

comparing the identifiers with a store of identifiers maintained in the expense recovery server;

transmitting a copy enable signal to the copier;

receiving from the copier transaction data relating to the job after completion of the job; and associating the transaction data with the identifiers.

15. The method of claim 14 further including the step of associating the transaction data with a default identifier if in the step of comparing the identifiers with the store of identifiers the identifiers are not found in the store of identifiers.

16. The method of claim 14 wherein the identifiers include one or more of: a copier identifier; a user identifier; and a client identifier.

17. The method of claim 14 wherein the transaction data includes one or more of: an identification code, a date time stamp; a copy count; and a transaction termination status.

18. A workflow method of accounting for a job at a copier including the steps of:

receiving a copy job request from a requestor;

receiving identifiers in the copier via an input means of the copier;

comparing the identifiers to a store of the identifiers;

enabling the copier with a copy enable signal;

after completion of the job, transmitting transaction data relating to the job to an expense recovery server via a communications network; and delivering the copy job to the requestor.

19. The method of claim 18 wherein the store of identifiers resides in the copier.

20. The method of claim 18 wherein the store of identifiers resides in a time and billing server in signal communication with the copier via the network.

21. The method of claim 18 wherein the store of identifiers resides in the expense recovery server.

22. The method of claim 18 wherein the copy enable signal is transmitted to the copier from the expense recovery server via the network.

23. The method of claim 18 further including a step of remotely monitoring the transaction data for compiling reports.

* * * * *